US011839918B2

(12) United States Patent
Proulx et al.

(10) Patent No.: US 11,839,918 B2
(45) Date of Patent: Dec. 12, 2023

(54) METHOD AND APPARATUS FOR PRODUCING HIGH PURITY SPHERICAL METALLIC POWDERS AT HIGH PRODUCTION RATES FROM ONE OR TWO WIRES

(71) Applicant: PYROGENESIS CANADA INC., Montreal (CA)

(72) Inventors: François Proulx, Montreal (CA); Christopher Alex Dorval Dion, Montreal (CA); Pierre Carabin, Montreal (CA)

(73) Assignee: PYROGENESIS CANADA INC., Montreal (CA)

( * ) Notice: Subject to any disclaimer, the term of this patent is extended or adjusted under 35 U.S.C. 154(b) by 0 days.

(21) Appl. No.: 16/972,949

(22) PCT Filed: Jun. 6, 2019

(86) PCT No.: PCT/CA2019/000081

§ 371 (c)(1),
(2) Date: Dec. 7, 2020

(87) PCT Pub. No.: WO2019/232612

PCT Pub. Date: Dec. 12, 2019

(65) Prior Publication Data

US 2021/0229170 A1 Jul. 29, 2021

Related U.S. Application Data

(60) Provisional application No. 62/681,623, filed on Jun. 6, 2018.

(51) Int. Cl.
*B22F 9/14* (2006.01)
*B22F 9/08* (2006.01)
(Continued)

(52) U.S. Cl.
CPC ..... *B22F 9/14* (2013.01); *B22F 1/065* (2022.01); *B22F 9/082* (2013.01); *H05H 1/26* (2013.01);
(Continued)

(58) Field of Classification Search
None
See application file for complete search history.

(56) References Cited

U.S. PATENT DOCUMENTS

2003/0102207 A1* 6/2003 Wu ..... C01G 19/00 422/186.04
2012/0018407 A1* 1/2012 Schramm ..... C23C 4/131 427/446
(Continued)

FOREIGN PATENT DOCUMENTS

WO WO-2011/054113 A1 * 5/2011
WO WO-2017/011900 A1 * 1/2017

*Primary Examiner* — George Wyszomierski
(74) *Attorney, Agent, or Firm* — Benoit & Côté Inc.; Michel Sofia

(57) ABSTRACT

The present application relates to a plasma atomization process and apparatus for producing metallic powders from at least one wire/rod feedstock. In the process, an electric arc is applied to the at least one wire/rod feedstock to melt the same. A plasma torch is employed to generate a supersonic plasma stream at an apex at which the electric arc is transferred to the at least one wire/rod feedstock to atomize the molten wire/rod feedstock into particles. A downstream cooling chamber solidifies the particles into the metallic powders. An anti-satellite diffuser is employed to prevent recirculation of the powders in order to avoid satellite formation. In an apparatus where two wires are fed, one wire serves as an anode, and the other as a cathode.

9 Claims, 10 Drawing Sheets

(51) Int. Cl.
*H05H 1/26* (2006.01)
*B22F 1/065* (2022.01)

(52) U.S. Cl.
CPC ..... *B22F 2009/0824* (2013.01); *B22F 2009/0848* (2013.01); *B22F 2202/13* (2013.01); *B22F 2999/00* (2013.01)

(56) References Cited

U.S. PATENT DOCUMENTS

| | | | | |
|---|---|---|---|---|
| 2016/0175936 | A1* | 6/2016 | Boulos ..... | B22F 9/14 75/346 |
| 2017/0349993 | A1* | 12/2017 | Santo Rosa ..... | H05H 1/3421 |
| 2018/0015438 | A1* | 1/2018 | Taylor ..... | B01J 19/0013 |

* cited by examiner

Ti-6Al-4V Grade 23

Zirconium

METHOD AND APPARATUS FOR PRODUCING HIGH PURITY SPHERICAL METALLIC POWDERS AT HIGH PRODUCTION RATES FROM ONE OR TWO WIRES

CROSS REFERENCE TO RELATED APPLICATIONS

This Application is a 371 National Phase filing from International Application No. PCT/CA2019/000081 filed on Jun. 6, 2019, which claims priority on U.S. Provisional Application No. 62/681,623, filed on Jun. 6, 2018, the entireties of which are herein incorporated by reference.

FIELD

The present subject matter relates to advanced materials and, more particularly, to the production of metal powders for diverse applications, such as additive manufacturing for the aerospace and medical industries.

BACKGROUND

Plasma atomization typically uses a wire as a feedstock, and a source of plasma (a.k.a. plasma torch) as atomizing agent to simultaneously melt and break-up the particles. Using a wire provides the stability required so that the narrow plasma jets are aiming properly at the wire, since the plasma jets have to melt the wire and atomize it in a single step. As best known, this technology currently produces the finest, most spherical and densest powders on the market. In other words, the yield of powders produced in the 0-106 micron range is very high, sphericity is near perfect, and gas entrapment is minimized.

However, this technology has the main disadvantage of having a relatively low production rate in comparison to water and gas atomization due to the fact that plasma atomization is a very energetically inefficient process. Reported production rates for plasma atomization are between 0.6 and 13 kg/h for Ti-6Al-4V. However, it is realistic to assume that operating around the upper bound will lead to a coarser particle size distribution. For example, U.S. Pat. No. 5,707,419, which is entitled "Method of Production of Metal and Ceramic Powders by Plasma Atomization" and issued in the names of Tsantrizos et al. on Jan. 13, 1998, reports a feed rate of 14.7 g/min or 0.882 kg/h for titanium, while U.S. Patent Application Publication No. 2017/0326649-A1, which is entitled "Process and Apparatus for Producing Powder Particles by Atomization of a Feed Material in the Form of an Elongated Member" and which was published on Nov. 16, 2017 with Boulos et al. as inventors, has reported a feed rate of 1.7 kg/h for stainless steel.

All three current plasma atomization technologies use either a single centrally fed torch [see reference 4], or three torches aiming at one wire at the center [see references 1, 2 and 3]. In the case of the three torches technology, heat transferred from the plasma plumes to the wire is very low, and in the order of magnitude of 0.4%. The low heat transfer efficiency implies the need for a large amount of plasma gas to maintain a certain metal feed rate, and this imposes a lower limit to the gas-to-metal ratio, a standard process efficiency metric in atomization. Also, using three torches means that many electrodes erode over time, which can be a source of contamination and increase the operating costs. In the case of the centrally fed torch, an inductively coupled plasma torch is used, for which the power supplies are difficult to obtain on the market.

Wire arc spray is a mature and reliable technology that is used in the field of thermal spray to apply coating onto surfaces. It essentially consists of passing a high current through one or two wires and having an electrical arc between the two wires, or between the single wire and an electrode. Quality wire arc systems can run with near 100% duty cycle at very high throughput (~20 to 50 kg/h), Moreover, this technology is highly energy efficient, since the arc contacts directly the wire. However, the purpose of this technology is to produce coatings and not to produce powders. Since this technology uses a cold gas to atomize the spray, it produces very irregular and angular shapes, which is not desirable for most applications.

It would therefore be desirable to provide an apparatus and method for producing metallic powders from one or two wires at a significant production rate while maintaining the quality provided by plasma atomization, namely fine, spherical and fully dense powders.

SUMMARY

It would thus be desirable to provide a novel apparatus and method for producing metallic powders at significant rates from one or two wires.

The embodiments described herein provide in one aspect a plasma atomization process comprising:

a thermal plasma torch;

one or two wires to be atomized fed continuously;

an electrical arc transferred to the wire or wires to be atomized; and a cooling process adapted to solidify the particles into spherical powders.

Also, the embodiment described herein provide in another aspect an apparatus for producing metallic powders from wire feedstock, comprising a plasma torch and a wire adapted to be fed in the plasma torch, the plasma torch being adapted to atomize the molten wire into particles, wherein an arc is adapted to be formed between the wire, which acts as a cathode, and an electrode.

Furthermore, the embodiments described herein provide in another aspect a plasma atomization process comprising:

providing a thermal plasma torch;

feeding continuously one or two wires to be atomized;

an electrical arc being adapted to be transferred to the wire or wires to produce particles; and providing cooling for solidifying the particles into spherical powders.

Furthermore, the embodiments described herein provide in another aspect an apparatus for producing metallic powders from wire feedstock, comprising a plasma torch and a wire adapted to be fed in the plasma torch, the plasma torch being adapted to atomize the molten wire into particles, wherein an arc is adapted to be formed between the wire, which acts as a cathode, and an electrode.

Furthermore, the embodiments described herein provide in another aspect an apparatus for producing metallic powders from wire feedstock, comprising a plasma torch and at least one wire adapted to be fed in the apparatus, the plasma torch being adapted to atomize the molten wire into particles, and a cooling chamber adapted to solidify the particles into powders, and wherein the wire is adapted to serve as a cathode in the plasma torch.

Furthermore, the embodiments described herein provide in another aspect an apparatus for producing metallic powders from wire feedstock, comprising a plasma torch and at least a pair of wires adapted to be fed in the apparatus, the plasma torch being adapted to atomize the molten wires into particles, wherein one of the wires is adapted to serve as an anode, whereas the other wire is adapted to serve as a cathode.

Furthermore, the embodiments described herein provide in another aspect an apparatus for producing metallic powders from wire feedstock, comprising a plasma torch and a wire adapted to be fed in the plasma torch, the plasma torch being adapted to atomize the molten wire into particles, wherein an arc is adapted to be formed between the wire, which acts as a cathode, and an electrode.

Furthermore, the embodiments described herein provide in another aspect an apparatus for producing metallic powders from wire feedstock, comprising a plasma torch and at least one wire adapted to be fed in the plasma torch, the plasma torch being adapted to atomize the molten wire into particles, wherein the apparatus is adapted to be cooled by a gas thereby heating up the gas, with the so heated gas being adapted to be used as the plasma gas.

Furthermore, the embodiments described herein provide in another aspect a plasma atomization process comprising:

providing a thermal plasma torch;

feeding continuously one or two wires to be atomized, thereby producing atomized metal droplets therefrom; and passing the droplets through an anti-satellite diffuser that is adapted to prevent the recirculation of fine powders and thus satellite formation.

Furthermore, the embodiments described herein provide in another aspect a plasma atomization process comprising:

providing a thermal plasma torch;

providing one or two wires to be atomized; and providing at least two power supplies in parallel for controlling an arc between the two wires or between the single wire and one electrode of the plasma torch, thereby producing particles.

BRIEF DESCRIPTION OF THE DRAWINGS

For a better understanding of the embodiments described herein and to show more clearly how they may be carried into effect, reference will now be made, by way of example only, to the accompanying drawings, which show at least one exemplary embodiment and in which.

DESCRIPTION OF VARIOUS EMBODIMENTS

Figure 1:
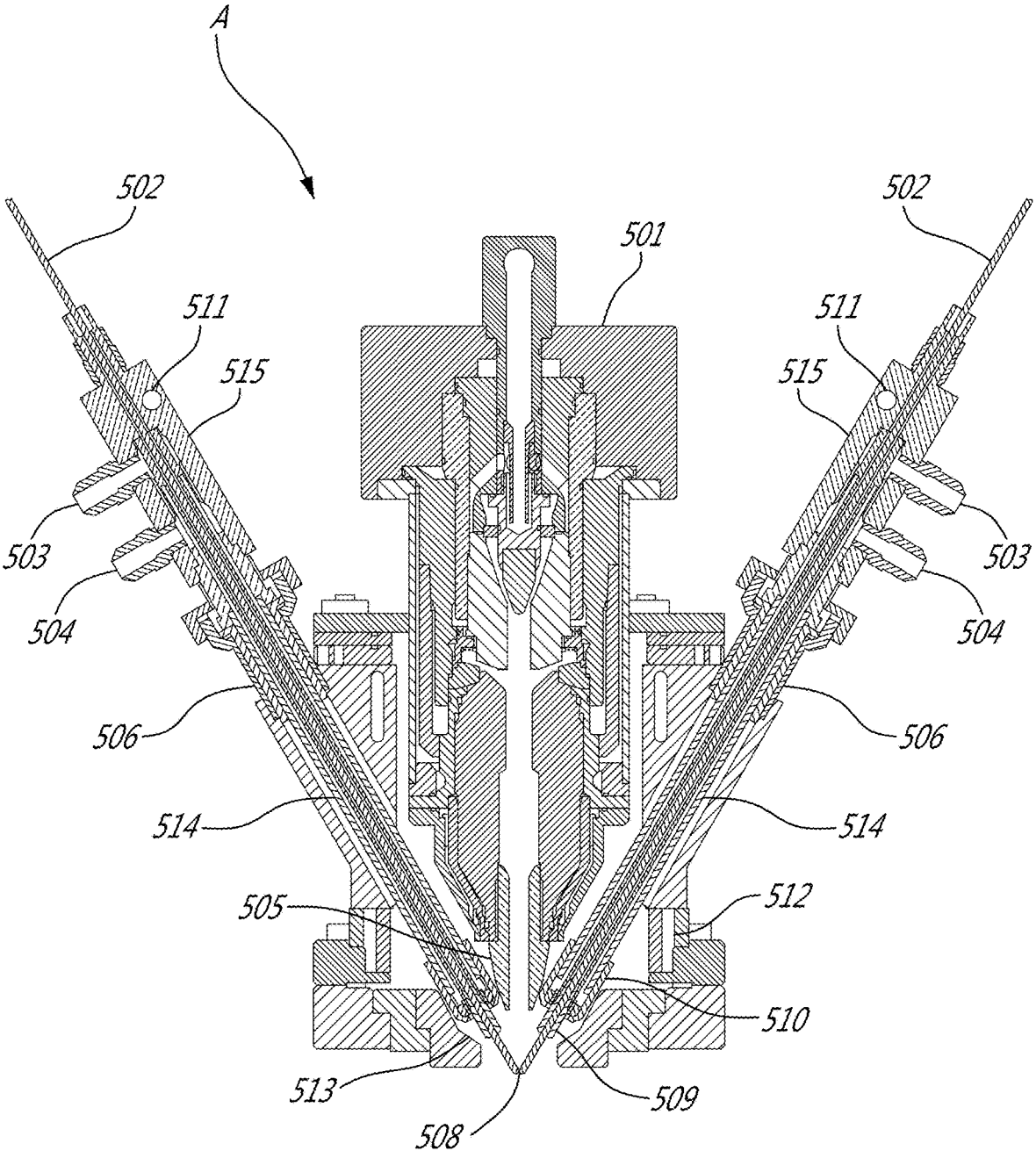
FIGS. 1 and 2 are vertical cross-sectional views of an apparatus for producing metallic powders from a pair of wires, using dual wire arc plasma atomization, in accordance with an exemplary embodiment.

The present approach disclosed herein provides methods and apparatuses for producing metallic powders, by combining features of the above-described plasma atomization and wire arc spray technologies, including by using some of the concepts of the wire arc spray technology and adapting it to make it suitable for the production of high purity spherical powders. More specifically, the gas jet is replaced by a source of plasma and the molten wire is atomized into a cooling chamber as seen in atomization processes.

One key consideration is powder quality. Wire arc was not developed for high quality powder production and must therefore be adapted and tuned towards powder quality. The current disclosure includes a control strategy that improves stability of the melting process, which will be described in more details further below.

A source of plasma (such as one or multiple plasma torches or an electrical arc), delivers a plasma stream that can be accelerated to supersonic velocity prior or after hitting the molten stream with high momentum.

In the current embodiments, the supersonic plasma jet source is produced via an arc plasma torch because it is widely available. However, many other ways could be used for achieving the same supersonic plasma jet. For example, any thermal plasma sources, such as inductively-coupled and microwave plasma sources, could be used as well.

Example 1: Dual Wire Arc Plasma Atomization (Main Embodiment)

The details of the main embodiment will now be described.

The benefits of using this embodiment over known technology (Ref. 2) are presented in Table 1. It shows a clear advantage in favor of using the current subject matter as opposed to the technology of Ref. 2.

TABLE 1

| Key Indicators (for Ti64) | Prior Art (Ref 2) | This Invention |
|---|---|---|
| Production rate (kg/h) | 5 | 28 |
| Gas to metal ratio | 26 | 5.5 |
| Stop to start time (h) | 2 | 0.5 |
| Specific Power (kWh/kg) for Ti64 | 31.2 | 4 |
| Thermal Efficiency (%) | 1.11 | 8.75 |

The recommended operating conditions of the main embodiment are disclosed in Table 2 for two materials, namely Ti64 grade 23 and Zirconium.

TABLE 2

| Material | Ti—6Al—4V Gr 23 | Zirconium |
|---|---|---|
| Run # | TA-015 | ZH-006 |
| Production Rate (kg/h) | 28 | 23.7 |
| Torch Power (kW) | 90 | 94 |
| Plasma gas flow (slpm) | 890 | 937 |
| Torch Sheath gas flow (slpm) | 260 | 200 |
| Main Sheath gas flow (slpm) | 400 | 400 |
| Wire size (mm) | 3.175 | 3.175 |
| Wire arc total current (A) | 740 | 515 |
| Wire arc voltage setting (V) | 30 | 26 |
| Wire arc melting efficiency (%) | 44 | 37 |

The performance of two products generated via the main embodiment are disclosed in Table 3, the two products being TA-015-EK-01 and ZH-006-FQ-01, which correspond to Ti64 20-63 μm and Zr 20-120 PM, respectively.

TABLE 3

| Product Name | TA-015-EK-01 | ZH-006-FQ-01 |
|---|---|---|
| Material & Size Cut | Ti64 20-63 μm | Zr 20-120 μm |
| Yield (%) | 32 | 64 |
| Apparent Density (g/cm^3) | 2.42 | 3.98 |
| Tap Density (g/cm^3) | 2.7 | Not measured |
| Hail Flow rate (s/50 g) | 25.91 | 15.42 |
| Aluminum (%) | 6.4 | Not applicable |
| Vanadium (%) | 4 | Not applicable |
| Oxygen (ppm) | 1000 | 1500 |

FIG. 1 details the specific components that make up apparatus A. These include a high flow rate plasma torch 501 and an anode integrated supersonic nozzle 505 that emits an atomizing jet onto a pair of wires 502 being fed towards an apex 508 whereupon an electrical arc is transferred from one wire to the other wire. This electrical current provides the energy necessary for the continuous melting of the conductive continuously fed feedstock. The current is passed to the wires 502 by contact tips 509 that are made of a high conductivity alloy, for example copper zirconium, which has a good wear resistance at high temperatures.

A ceramic tip 510 provides the electrical insulation of a water-cooled contactor 514 from the body of the reactor through a gas sheath nozzle 513 and of the torch's supersonic nozzle 505. The intense heat emitted by the plasma torch 501 and the transferred arc requires the contactors to be water cooled while the contact tip itself is a replaceable consumable. As such, water enters at 503 the contactor's manifold 515 at the rear and is directed towards the tip where it is returned upwards again and out through exit 504. Electrical power is provided to the transferred arc system via the manifolds through a lug mount 511.

Figure 2:
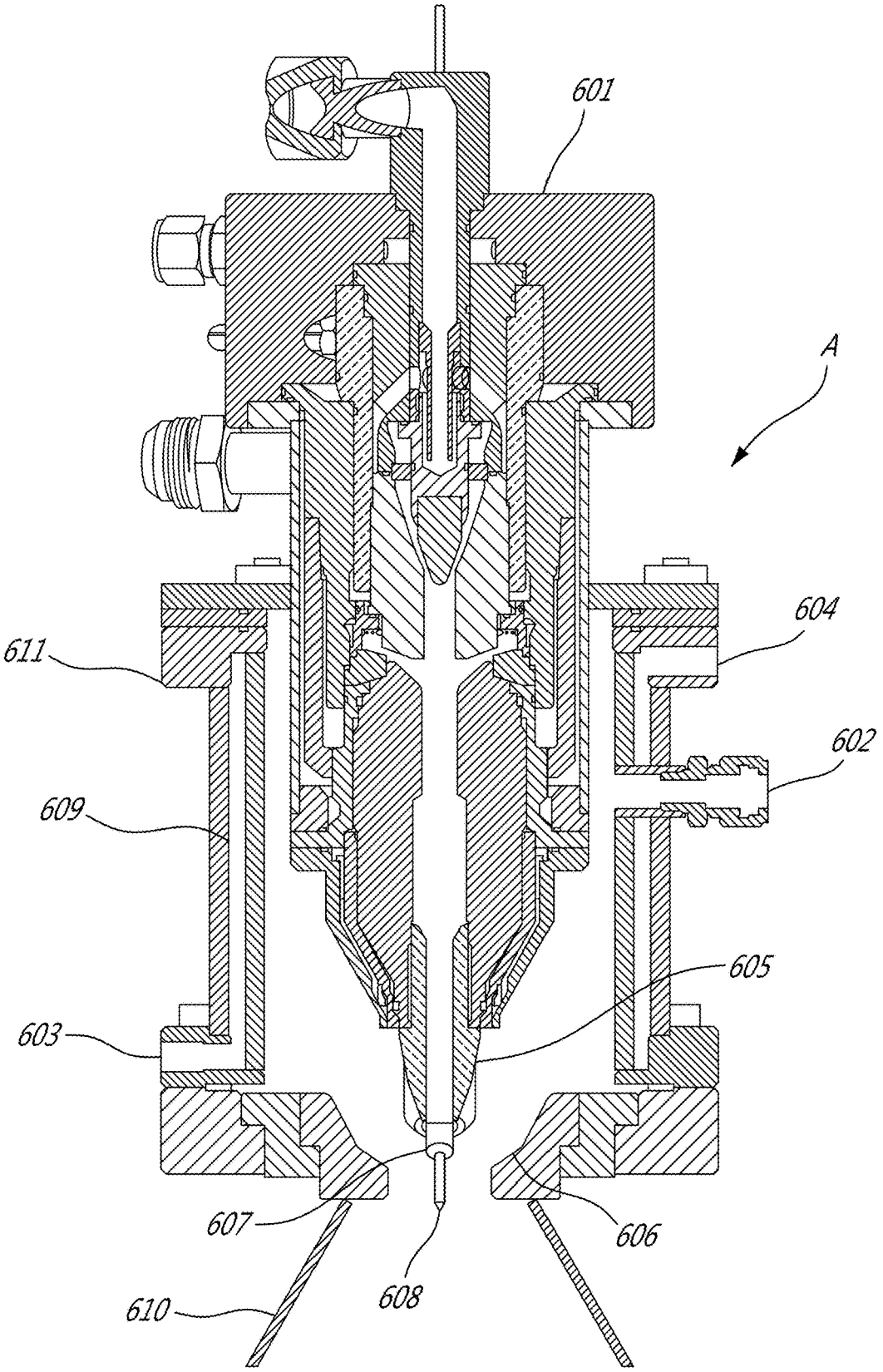

FIG. 2 shows a perpendicular cut view of the apparatus A, where the high flow rate plasma torch emits an atomizing jet via the supersonic nozzle 605 at the wire apex 608. Here a sheath gas is injected into the reactor at 602 to fill the cavity surrounding the torch's nozzle and water-cooled contactors 607. This sheath gas is expelled via the sheath gas nozzle 606 into the reactor surrounding the electrical arc between the wires. This sheath gas serves multiple purposes, such as it prevents back flow of powders and hot gases as well as aid in maintaining the arc within the supersonic plume. The mixing gas flows and molten atomized metal droplets are then projected at high velocities into the settling chamber of the reactor via an anti-satellite diffuser 610. A recirculation zone around the high velocity jet where fine powders can accumulate in suspension is the primary cause of satellites in plasma-atomized powders as new droplets are projected through a cloud of fines which are thus welded to the surface. The diffuser 610 removes the vast majority of this occurrence, thus greatly reducing satellite formation. A torch receiver 611 is water-cooled as the reactor's jacket, water enters from an inlet 603 at the bottom and an outlet 604 at the top.

Figure 3:
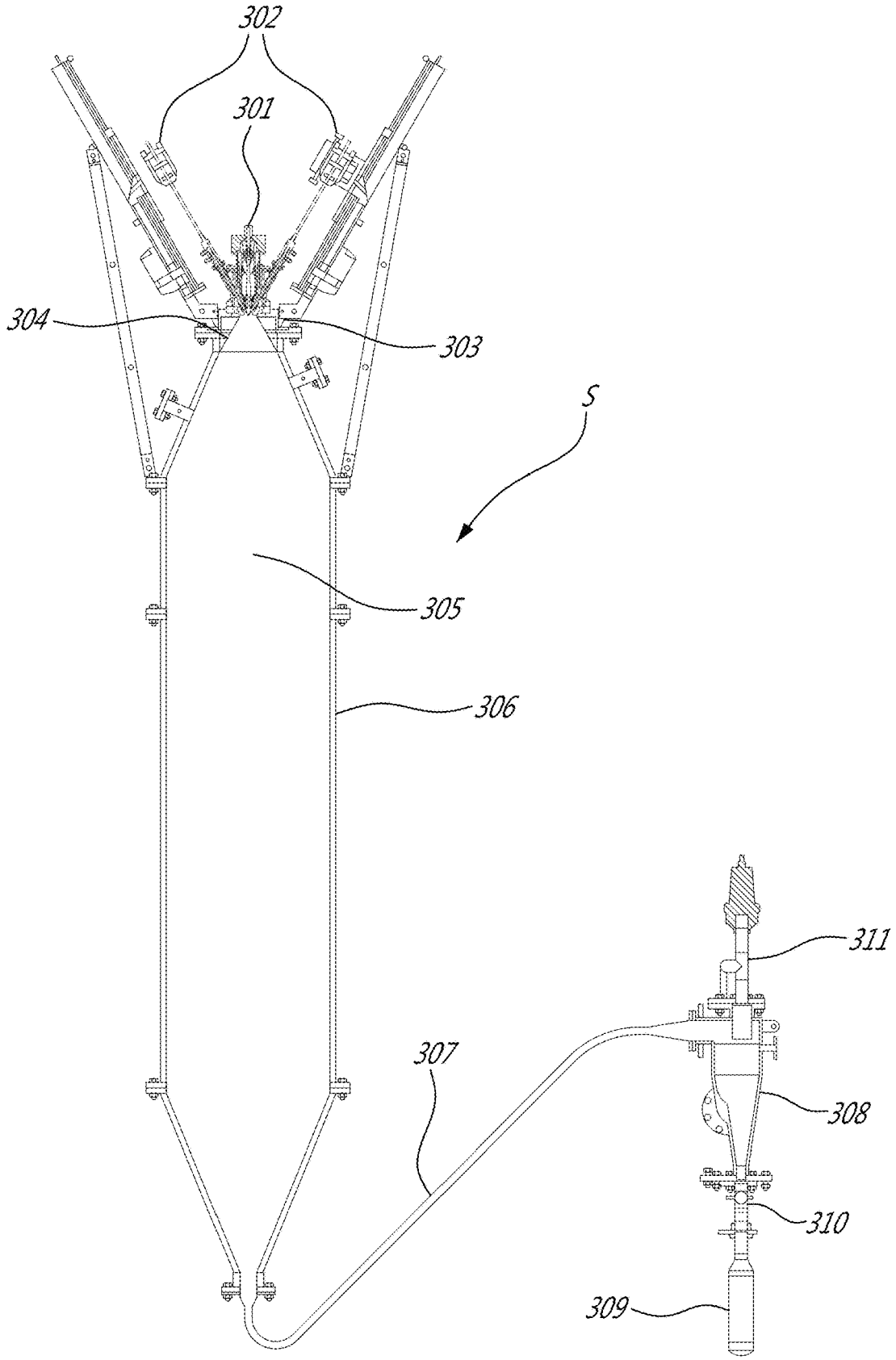
FIG. 3 is a schematic elevation view of a system for producing metallic powders, which uses the apparatus shown in FIGS. 1 and 2, in accordance with an exemplary embodiment, including that of FIGS. 1 and 2.

FIG. 3 schematically illustrates a system S adapted to produce metallic powders, and embodying either one of the apparatuses A, A' and A", respectively, of FIGS. 1-2, 9 and 10. More particularly, the system S includes the dual-wire or single-wire plasma-based atomization apparatuses A, A' or A". The system S is shown specifically in its twin wire arc configuration A with a centrally located high flow rate plasma torch 301 and the two (2) servo driven wire feeders 302. An atomization zone 303 comprises of the transferred arc between the one or two wires, the sheath gas and plasma torch flow and is directed into the reactor by way of an anti-satellite diffuser 304. The reactor is comprised of a settling chamber 305 where spheroidization and solidification occur, and a water-cooled jacket 306 to maintain a constant cooling rate in the chamber 305 for the powders. The powders are then entrained via a pneumatic conveyor 307 to a cyclonic separator 308 where the bulk powders settle in a collection canister 309. A valve 310 is used to isolate the canister 309 for collection during continuous operation. The argon is then vented from the system through a filtration unit 311 for powders too fine to settle out in the cyclonic separator 308.

In the current embodiments, the wires 502 (FIG. 1), 110 (FIG. 10) and 405 (FIG. 9) can be made of various conductive materials, such as titanium, zirconium, copper, tin, aluminum, tungsten, carbon steel, stainless steel, etc., and their alloys.

To ensure stability of the wire arc system for atomization, the system needs to control 2 out of 3 parameters, namely voltage, current and feed speed. These three parameters need to reach a steady state in equilibrium to be considered in continuous operation. In steady state, the distance between the wire, the length of the arc and the power become constant. To reach this steady state, several configurations can be employed, such as:

Fixed wire speed, one power supply in voltage-controlled mode, one power supply in current controlled mode (main embodiment);

Fixed wire speed, one or multiple voltage-controlled power supplies. This configuration is functional but current is highly unstable, which has a negative impact on particle size distribution and product consistency. Furthermore, it is highly demanding on both power supplies;

Current-controlled power supplies, variable wire speed. This configuration has yet to be tested, but would work in theory.

Figure 4:
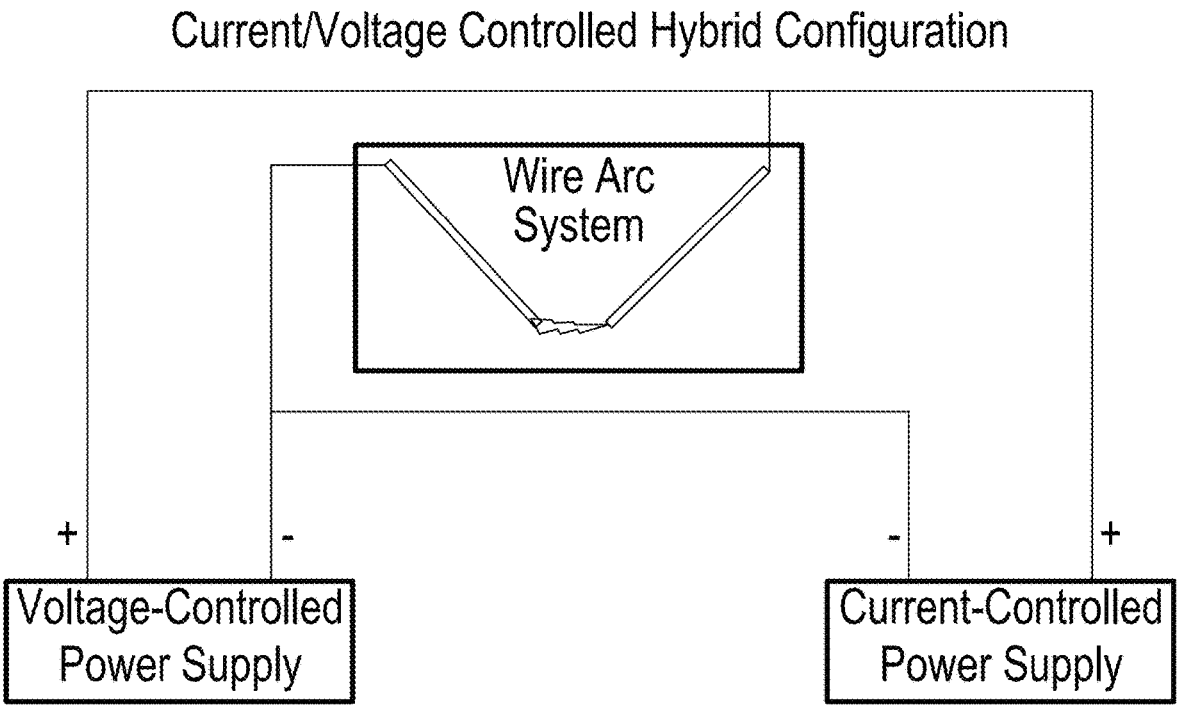
FIG. 4 is a conceptual schematic of an electrical configuration used in accordance with an exemplary embodiment, including that of FIGS. 1 and 2.

Fixed wire speed, current/voltage-controlled hybrid power supply was found to be most suitable for the present application. FIG. 4 shows conceptually how the main embodiment was operated to obtain the results shown in the current disclosure.

Using a Servo motor, it is possible to have very precise and constant feed speeds.

Using two power supplies in parallel, one in voltage-controlled mode and another one in current-controlled mode, is the key to achieve a stable configuration. Since the two power supplies are in parallel, the voltage-controlled one will force the same voltage to both power supplies to be fixed. This removes another variable. To add another layer of stability, the other power supply is set to current control mode, with a relatively high current setting (around ⅔ of the total current required), which helps to create a current baseline.

The only variable in the process is a portion of the total current, which needs to fluctuate to allow the other parameters to remain constant (degree of freedom). Therefore, the voltage-controlled power supply provides an additional current that is variable to complement what is missing to the current already provided by the current-controlled power supply to melt the proper amount of metal, so the system remains in steady state.

For example, assuming 20 kW are required to melt a certain metal at a certain feed speed, and assuming that this feed speed remains constant, if the voltage was fixed at 30 V by the voltage-controlled power supply, a total of 667 A must be supplied by the power supplies. If the current-controlled power supply is set at 400 A, the voltage-controlled one would fluctuate around 267 A with little ripples. This remaining fluctuation is required to keep the system in steady state by compensating against all other sources of variability of the process, such as wire diameter variation, argon flow rate fluctuation, arc length variability, arc restrike pattern, mechanical vibration of the wire, wire feed speed micro-fluctuations, etc.

Figure 5:
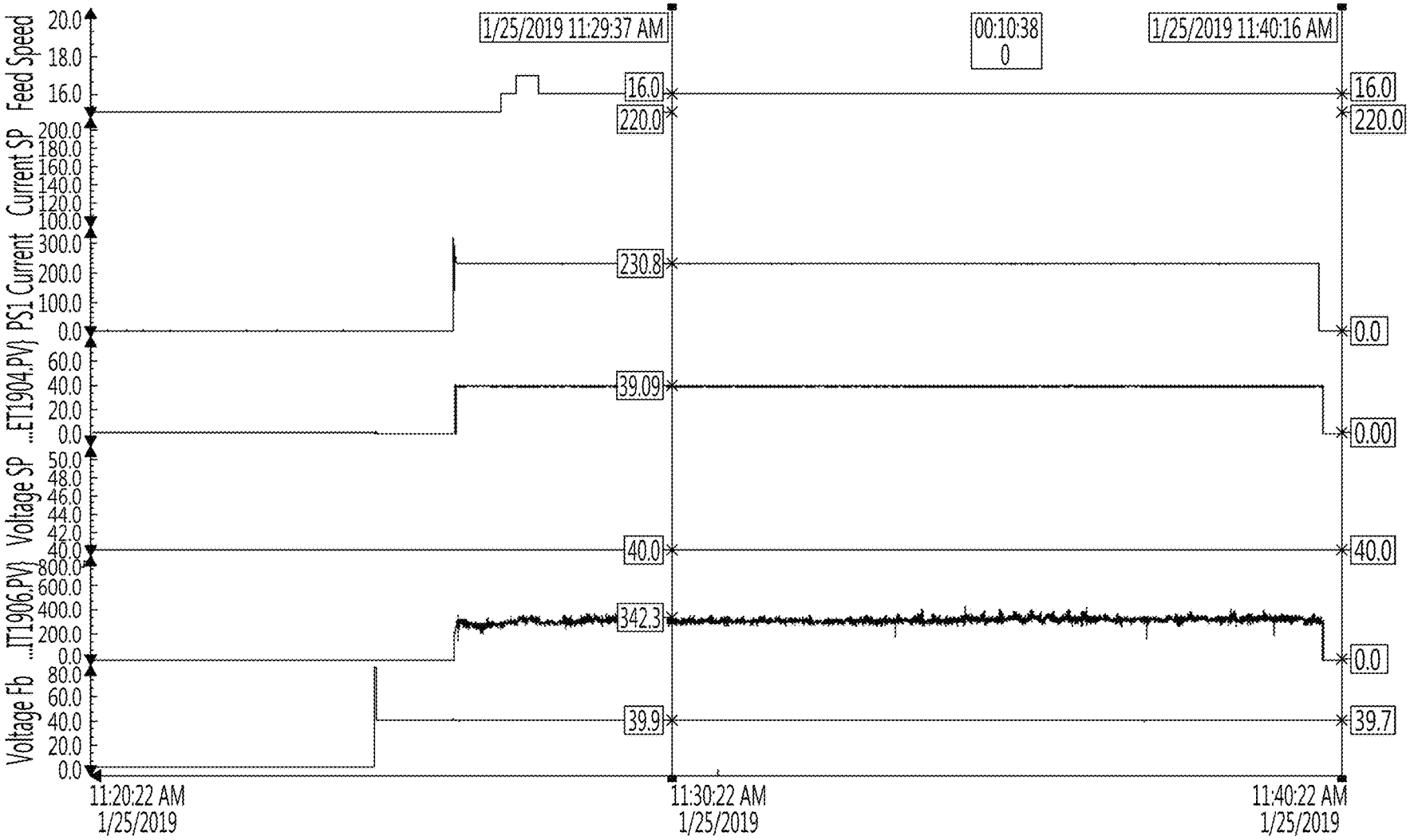
FIG. 5 shows an example of electrical trendlines of embodiments in operation of the present disclosure.

FIG. 5 shows the electrical trendlines recorded for the main embodiment during operation using the electrical control strategy herein suggested. In summary, it shows that all variables are highly stable except for the current of the voltage-controlled power supply, for reasons explained above.

Figure 6:
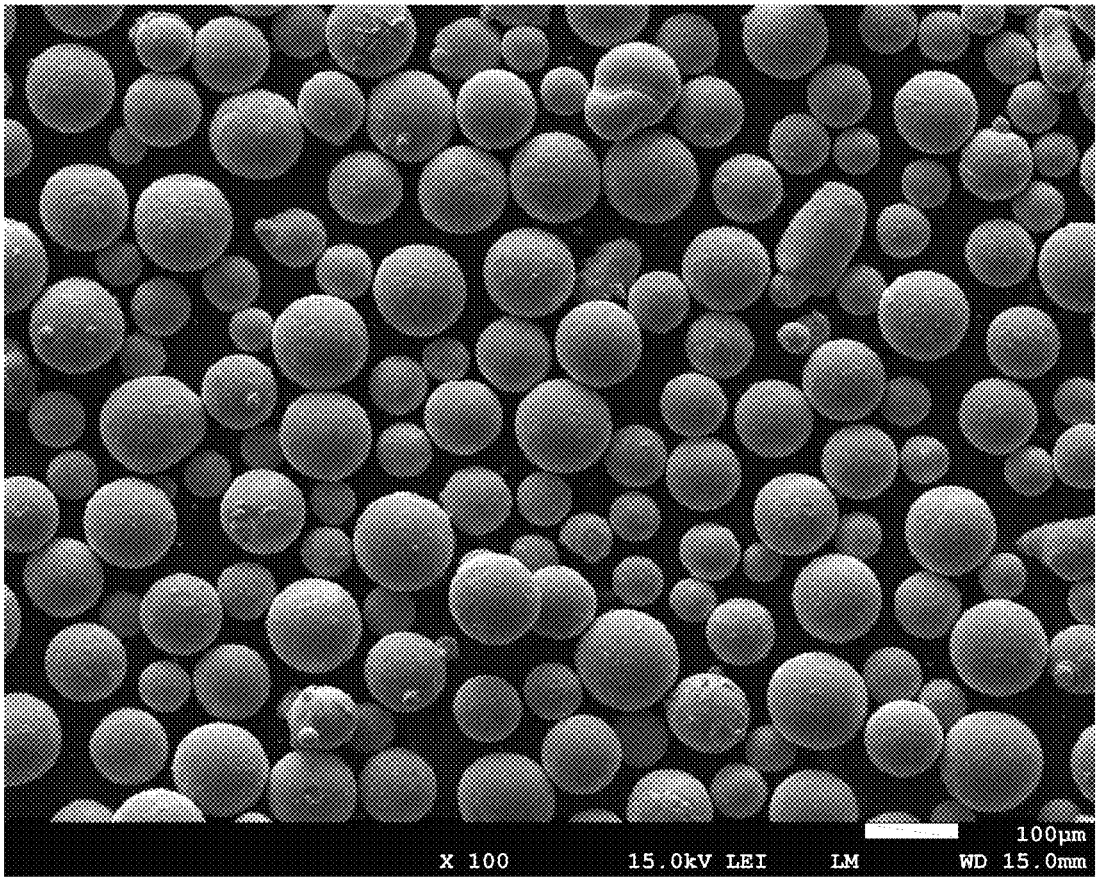
FIG. 6 is a SEM image of 100 times magnification of 45-106 μm Ti64 grade 23 powder produced by the means of the embodiment of FIGS. 1 and 2.
Figure 7:
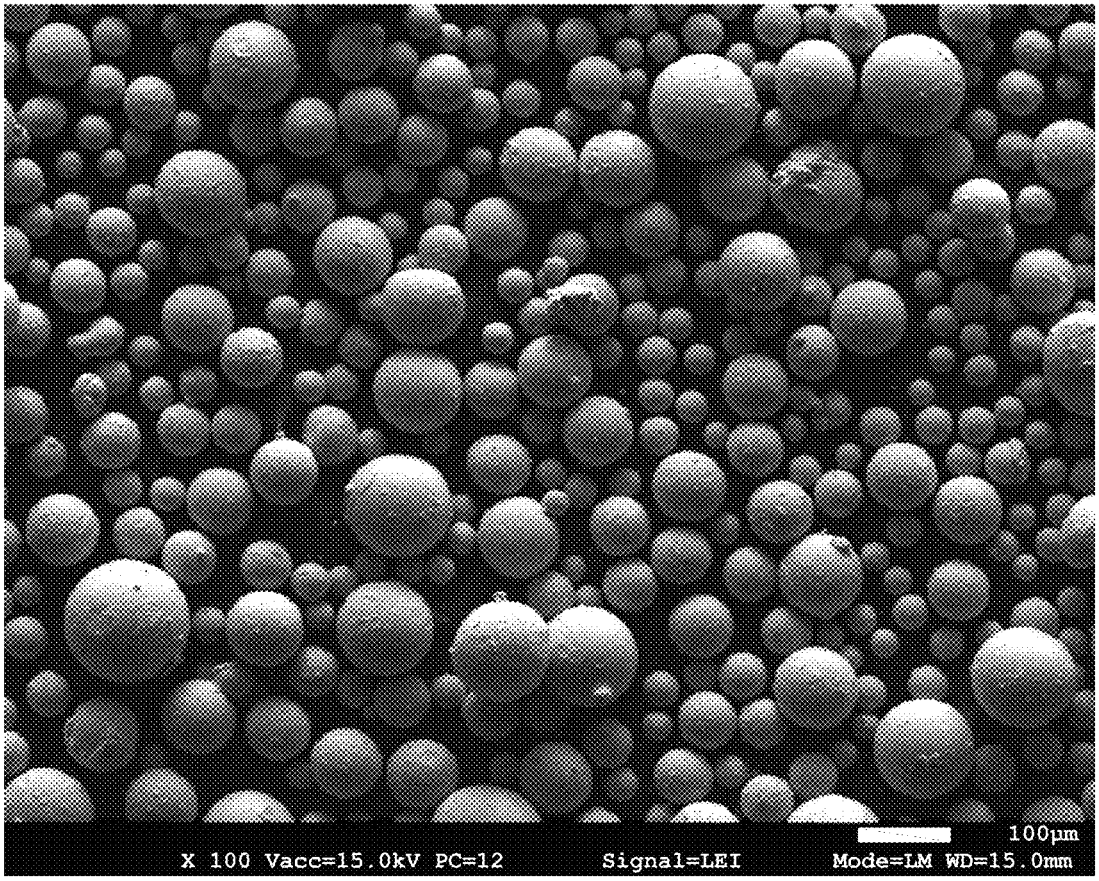
FIG. 7 is a SEM image of 100 times magnification of 20-120 of Zirconium powder produced by the means of the embodiment of FIGS. 1 and 2.

Such stable operation, as shown in FIG. 5, allows to produce highly spherical powders, as shown in FIGS. 6 and 7, for Ti64 and Zirconium, respectively.

Figure 8:
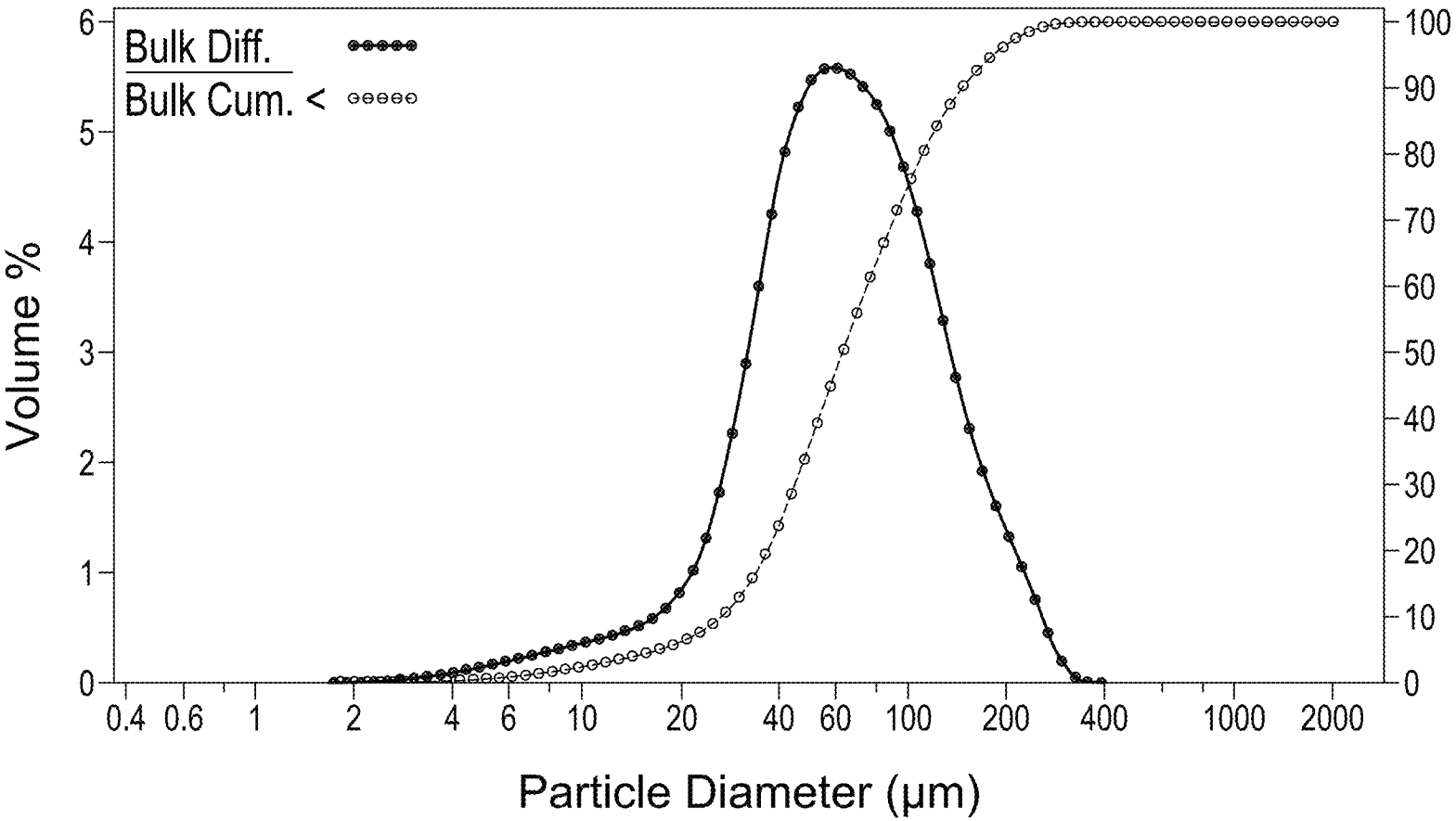
FIG. 8 shows a typical laser diffraction powder size distribution graph for a raw powder produced by the means of at least one embodiment herein disclosed.

FIG. 8 shows a typical particle-size distribution curve for powder produced using the main embodiment with the electrical control strategy herein explained.

Although the current control herein presented is mentioned and tested specifically for the main embodiment, the same control strategy would apply to other embodiments presented as well.

Example 2: Single-Wire Arc Plasma Atomization

Figure 9:
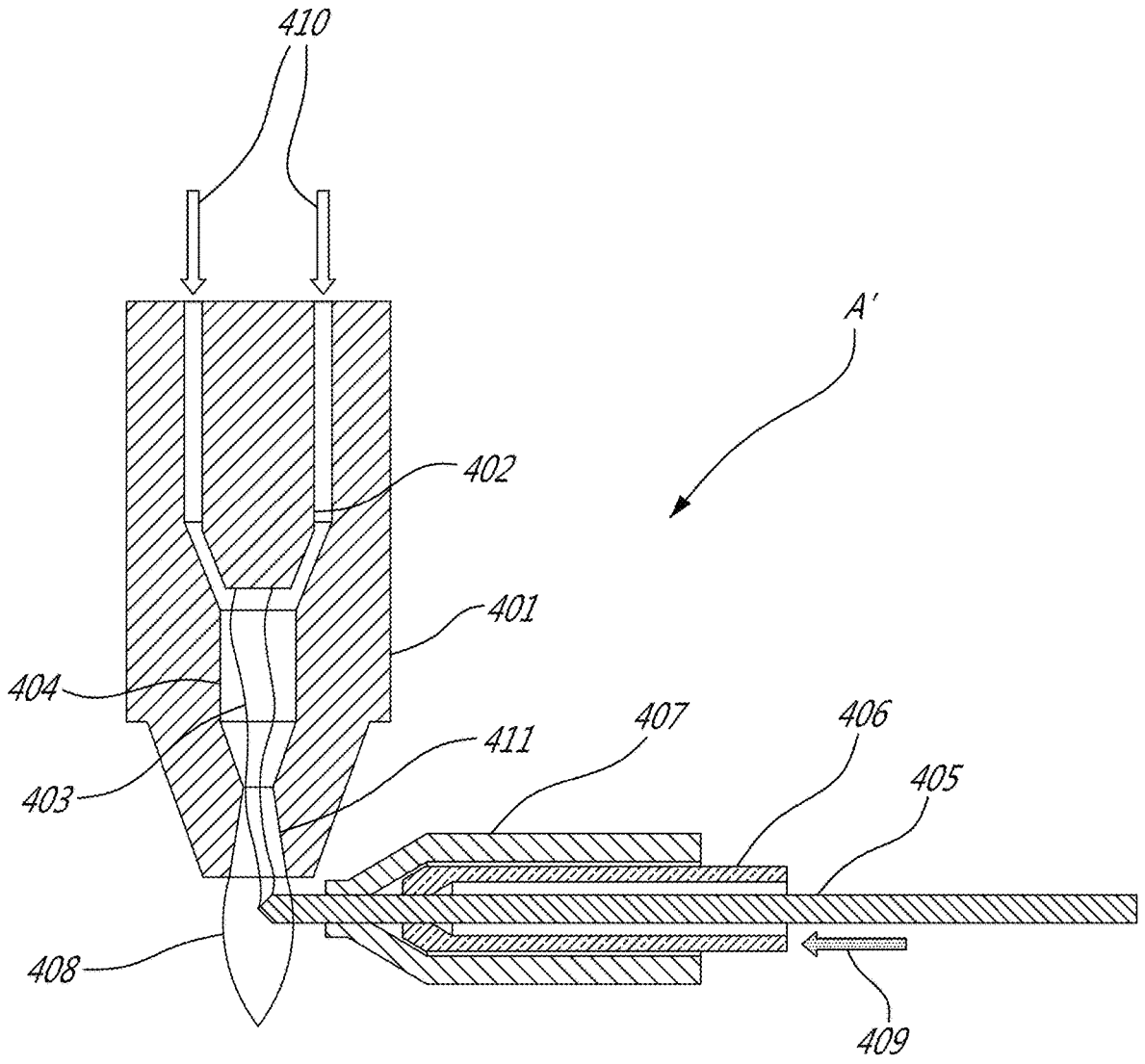
FIG. 9 is a schematic vertical cross-sectional view of an apparatus for producing metallic powders from a single wire, using a plasma torch which can transfer an arc with the said single wire, in accordance with an exemplary embodiment.

In the second example shown in FIG. 9, an apparatus A' for producing metallic powders from a conductive wire feedstock is also disclosed, wherein a wire 405 is centrally fed along arrow 409 in front of a transferred plasma torch 401 equipped with a supersonic nozzle 411, where an arc 403 is formed between the wire 405, and one electrode 402. By inserting the conductive wire 405 through a wire guide 407 in front of the plasma torch 401, the wire 405 itself can be melted very efficiently via a transferred arc. The remaining energy is then used to warm up an inert gas (e.g. argon), fed via a pre-heated gas channel 404, to plasma state, which gas is then accelerated through the supersonic nozzle. 411 This acceleration of the carrier gas atomizes the metal droplets further by shredding them. The particles then solidify into small spherical particles in a cooling chamber (as exemplified in FIG. 3), for instance filled with an inert gas (e.g. argon). Reference 408 denotes a plasma plume.

Example 3: Centrally-Fed Single Wire Arc Plasma Atomization

Figure 10:
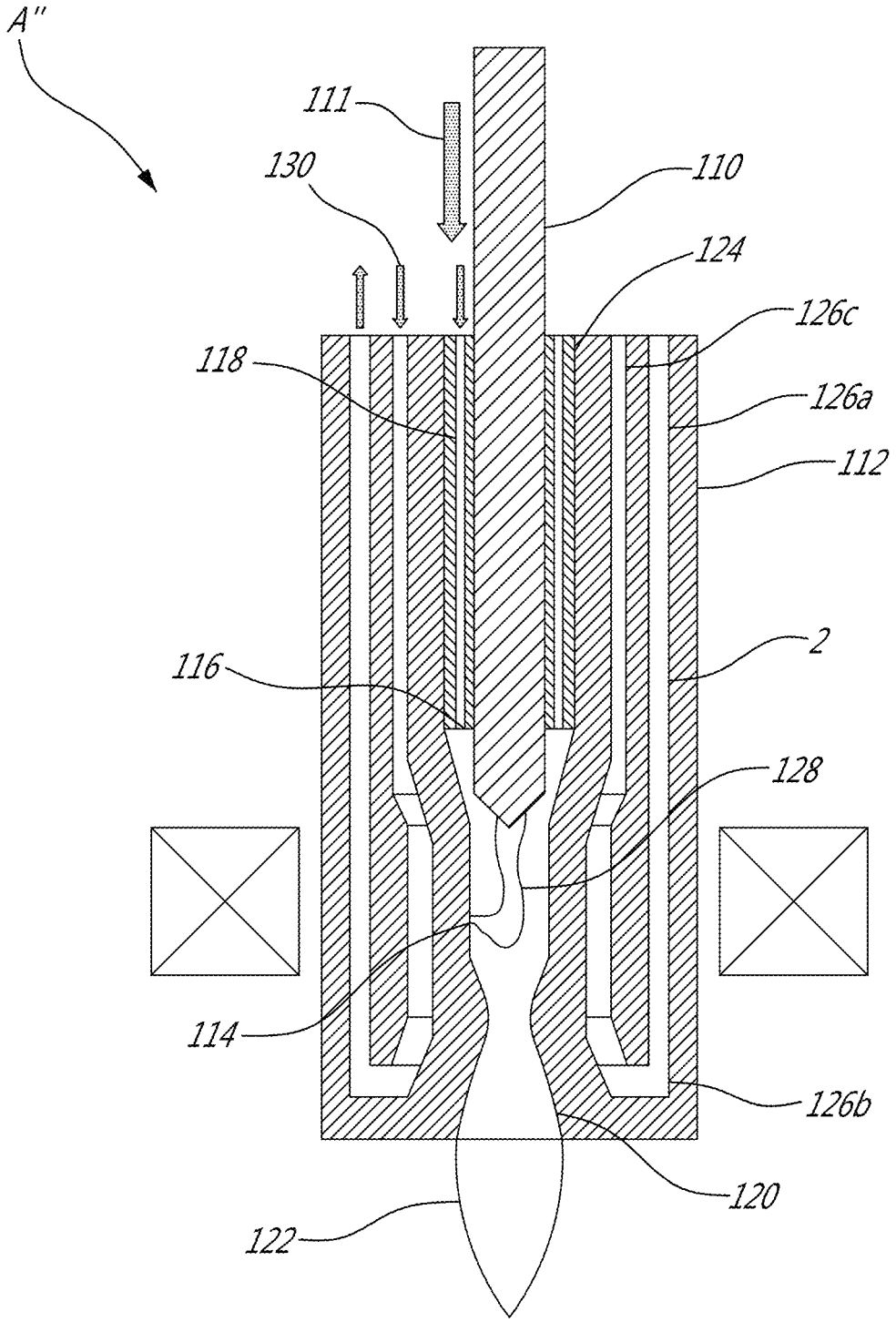
FIG. 10 is a schematic vertical cross-sectional view of an apparatus for producing metallic powders from a single wire, using a centrally fed plasma torch, in accordance with an exemplary embodiment.

In the third example shown in FIG. 10, an apparatus A" for producing metallic powders from a conductive wire feedstock is also disclosed, wherein a wire 110 is centrally fed along arrow 111 into a plasma torch 112, where an arc 128 is formed between the wire 110, which acts as a cathode, and one electrode (see anode 114). By inserting the conductive wire 110 through a wire guide 116 of the plasma torch 112, the wire 110 itself can be melted very efficiently via a transferred arc. This method is singled out as having a scale up capability in the sense that the wire can most feasibly be exchanged for a rod or billet of up to 2.5 inches in diameter. The wire guide 116 can double as an ignition cathode. The remaining energy is then used to warm up an inert gas (e.g. argon), fed via a pre-heated gas channel 118, to plasma state, which gas is then accelerated through a supersonic nozzle 120. This acceleration of the carrier gas atomizes the metal droplets further by shredding them. The particles then solidify into small spherical particles in a cooling chamber (as exemplified in FIG. 3), for instance filled with an inert gas (e.g. argon). Reference 122 denotes a plasma plume.

The embodiments described herein provide in one aspect an apparatus for producing metallic powders from wire feedstock, comprising a plasma torch and one or two wires adapted to be fed in the apparatus, the plasma torch being adapted to atomize the molten wire into particles, and a cooling chamber adapted to solidify the particles into powders, and wherein the wire is adapted to serve as a cathode in the plasma torch.

Also, the embodiment described herein provide in another aspect an apparatus for producing metallic powders from wire feedstock, comprising a plasma torch and a pair of wires adapted to be fed in the apparatus, the plasma torch being adapted to atomize the molten wires into particles, wherein one of the wires is adapted to serve as an anode, whereas the other wire is adapted to serve as a cathode.

Moreover, an embodiment includes an electrical control strategy that allows for the smooth and stable operation of the said embodiment.

Furthermore, the embodiments described herein provide in another aspect an apparatus for producing metallic powders from wire feedstock, comprising a plasma torch and a wire adapted to be fed into the apparatus, the plasma torch being adapted to atomize the molten wire into particles, wherein an arc is adapted to be formed between the wire, which acts as a cathode, and an electrode of the torch.

Finally, the embodiments described herein provide in another aspect an apparatus for producing metallic powders from wire feedstock, comprising a plasma torch and at least one wire adapted to be centrally fed inside the plasma torch, the plasma torch being adapted to atomize the molten wire into particles, wherein an arc is adapted to be formed between the wire, which acts as a cathode, and an electrode within the torch.

While the above description provides examples of the embodiments, it will be appreciated that some features and/or functions of the described embodiments are susceptible to modification without departing from the spirit and principles of operation of the described embodiments. Accordingly, what has been described above has been intended to be illustrative of the embodiments and non-limiting, and it will be understood by persons skilled in the art that other variants and modifications may be made without departing from the scope of the embodiments as defined in the claims appended hereto.

REFERENCES

[1] Peter G. Tsantrizos, Francois Allaire and Majid Entezarian, "Method of Production of Metal and Ceramic Powders by Plasma Atomization", U.S. Pat. No. 5,707,419, Jan. 13, 1998.

[2] Christopher Alex Dorval Dion, William Kreklewetz and Pierre Carabin, "Plasma Apparatus for the Production of High-Quality Spherical Powders at High Capacity", PCT Publication No. WO 2016/191854 A1, Dec. 8, 2016.

[3] Michel Drouet, "Methods and Apparatuses for Preparing Spheroidal Powders", PCT Publication No. WO 2011/054113 A1, May 12, 2011.

[4] Maher I. Boulos, Jerzy W. Jurewicz and Alexandre Auger, "Process and Apparatus for Producing Powder Particles by Atomization of a Feed Material in the Form of an Elongated Member", U.S. Patent Application Publication No. 2017/0326649 A1, Nov. 16, 2017.

[5] Pierre Fauchais, Joachim Heberlein, and Maher Boulos, "Thermal Spray Fundamentals—From Powder to Part", pp 577-605, Springer, New York, 2014.

The invention claimed is:

1. An apparatus for producing metallic powders from wire feedstock, comprising a plasma torch, a supersonic nozzle and at least a pair of wires adapted to be fed in the apparatus, the plasma torch being adapted to atomize the wires into particles, wherein an electrical arc is adapted to be formed between the wires, one of which acting as a cathode, and an electrode.

2. The apparatus of claim 1, wherein the wires are centrally fed into the plasma torch.

3. The apparatus of claim 1, wherein the electrical arc is generated within the supersonic nozzle.

4. The apparatus of claim 3, wherein the wires are adapted to be fed into the supersonic nozzle, either before or after a throat of the supersonic nozzle.

5. The apparatus of claim 3, wherein a power supply is provided and is adapted to force current to pass through the wires, with the electrical arc being generated between the two wires and within the supersonic nozzle.

6. The apparatus of claim 1, wherein a cooling chamber is provided downstream of the plasma torch for solidifying the particles into spherical powders.

7. The apparatus of claim 1, wherein one of the wires is adapted to serve as an anode, whereas the other wire is adapted to serve as the cathode.

8. The apparatus of claim 7, wherein a power supply is provided and is adapted to force current to pass through the wires, with the electrical arc being generated between the two wires.

9. The apparatus of claim 1, wherein a wire guide is provided for the wires, whereby by inserting the wires through the wire guide, the wires are adapted to be melted via a transferred arc.

* * * * *